US006438858B1

(12) United States Patent
Arnold, Jr. et al.

(10) Patent No.: US 6,438,858 B1
(45) Date of Patent: Aug. 27, 2002

(54) ELECTRONIC FEELER GAUGE

(75) Inventors: Joseph Nelson Arnold, Jr., Louisburg; David Campbell Brower, Wake Forest; Robert Joseph Heider, Durham; Herbert Gene Leonard, Louisburg, all of NC (US)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 09/478,613

(22) Filed: Jan. 14, 2000

(51) Int. Cl.[7] ..... G01B 7/14
(52) U.S. Cl. ..... 33/542; 33/501.6
(58) Field of Search ..... 33/645, 501.02, 33/501.03, 501.05, 501.08, 501.09, 501.45, 501.6, 613, 614, 542; 340/678

(56) References Cited

U.S. PATENT DOCUMENTS

| | | | | | |
|---|---|---|---|---|---|
| 2,208,910 | A | * | 7/1940 | Pampel et al. | 33/501.6 |
| 4,112,355 | A | * | 9/1978 | Gibson, Jr. et al. | 33/501.6 |
| 4,345,380 | A | | 8/1982 | Vis | |
| 4,872,269 | A | * | 10/1989 | Sattmann | 33/542 |
| 5,067,250 | A | | 11/1991 | Auweiler et al. | 33/783 |
| 5,337,488 | A | | 8/1994 | Lemelson | 33/784 |
| 5,492,003 | A | | 2/1996 | D'Anna | 33/704 |
| 5,657,550 | A | | 8/1997 | Struble | 33/548 |
| 6,094,831 | A | * | 8/2000 | Shigyo | 33/542 |

* cited by examiner

*Primary Examiner*—Christopher W. Fulton
(74) *Attorney, Agent, or Firm*—J. Bruce Schelkopf; Winstead Sechrest & Minick

(57) ABSTRACT

An electronic feeler gauge and a method of using the same which provides an objective means of determining the width of a gap between two surfaces. The gauge comprises a measuring element which is insertable into the gap and an indicator coupled to the measuring element for automatically indicating when the gap has been set to a predetermined distance. The measuring element comprises two plates which act as an electrical switch in an electrical circuit. When the gap gauge is inserted into a gap of predetermined width, the plates press against each other and current from a power source lights up a light emitting diode. Conversely, when the plates are inserted into a gap that is too wide, the plates do not press against each. The circuit, therefore, is not complete, and the light emitting diode does not light up. Thus, this invention provides an objective, reliable means for confirming the width of a gap. The invention can be used for gaps of different widths by varying the thicknesses of the plates.

16 Claims, 6 Drawing Sheets

ELECTRONIC FEELER GAUGE

TECHNICAL FIELD

The present invention relates in general to measuring instruments, and in particular, to a method and apparatus for ascertaining the gap between opposing parts.

BACKGROUND INFORMATION

In manufacturing quality control, it is often necessary to verify the width of a gap between two adjacent, opposing surfaces. For example, when servicing a computer printer, it is required to optimally set the distance between an end part of a printing head and a surface of a printing medium in order to obtain high quality printing on the printing medium. This distance is called a print gap. It is, therefore desirable to preset the print gap in accordance with the thickness of the recording medium, such as paper.

Currently, print gaps and similar gaps are measured with a plurality of shim or wire gauges ("feeler" gauges). Feeler gauges are thin steel plates of a predetermined thickness. The width of a gap is measured by a feeler gauge by inserting the gauge into the gap and moving the gauge back and forth within the gap. The amount of frictional resistance between the gauge and the opposing surfaces increases as thicker gauges are inserted into the gap. A gauge that is too thin will result in little or no frictional resistance when inserted into the gap. On the other hand, if the gauge is too thick, insertion will be impossible or will be achieved with great difficulty. Thus, it is possible to determine width of the gap by judging the degree of frictional resistance.

Judging the correct amount of frictional resistance is subjective and is dependent on the experience of the operator. Often an inexperienced operator may not be able to repeat the same result because he is relying on his judgment regarding the correct degree of frictional resistance. Furthermore, other operators may not be able to reproduce the results even with the same gauge.

What is needed, therefore, is an inexpensive device to objectively determine whether a gap has been set to the proper tolerances.

SUMMARY OF THE INVENTION

The previously mentioned needs are fulfilled with the present invention. Accordingly, there is provided, in a first form, a feeler gauge which provides an objective means of determining the width of a gap. The feeler gauge comprises a gap measuring element which is insertable into the gap and an indicator coupled to the gap measuring element for automatically indicating when said gap has been set to a predetermined distance. The measuring element comprises two plates which act as a switch in an electrical circuit. When the gap gauge is inserted into a gap of predetermined width, the plates press against each other and current from a power source lights up a light emitting diode. Conversely, when the plates are inserted into a gap that is too wide, the plates do not press against each. The circuit, therefore, is not complete, and the light emitting diode does not light up. Thus, this invention provides an objective, reliable means for confirming the width of a gap. The invention can be used for gaps of different widths by varying the thicknesses of the plates.

These and other features, and advantages, will be more clearly understood from the following detailed description taken in conjunction with the accompanying drawings. It is important to note the drawings are not intended to represent the only form of the invention.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF THE INVENTION

The principles of the present invention and their advantages are best understood by referring to the illustrated embodiments depicted in FIGS. 1–4 of the drawings, in which like numbers designate like parts. In the following description, well-known elements are presented without detailed description in order not to obscure the present invention in unnecessary detail. For the most part, details unnecessary to obtain a complete understanding of the present invention have been omitted inasmuch as such details are within the skills of persons of ordinary skill in the relevant art.

Figure 1:
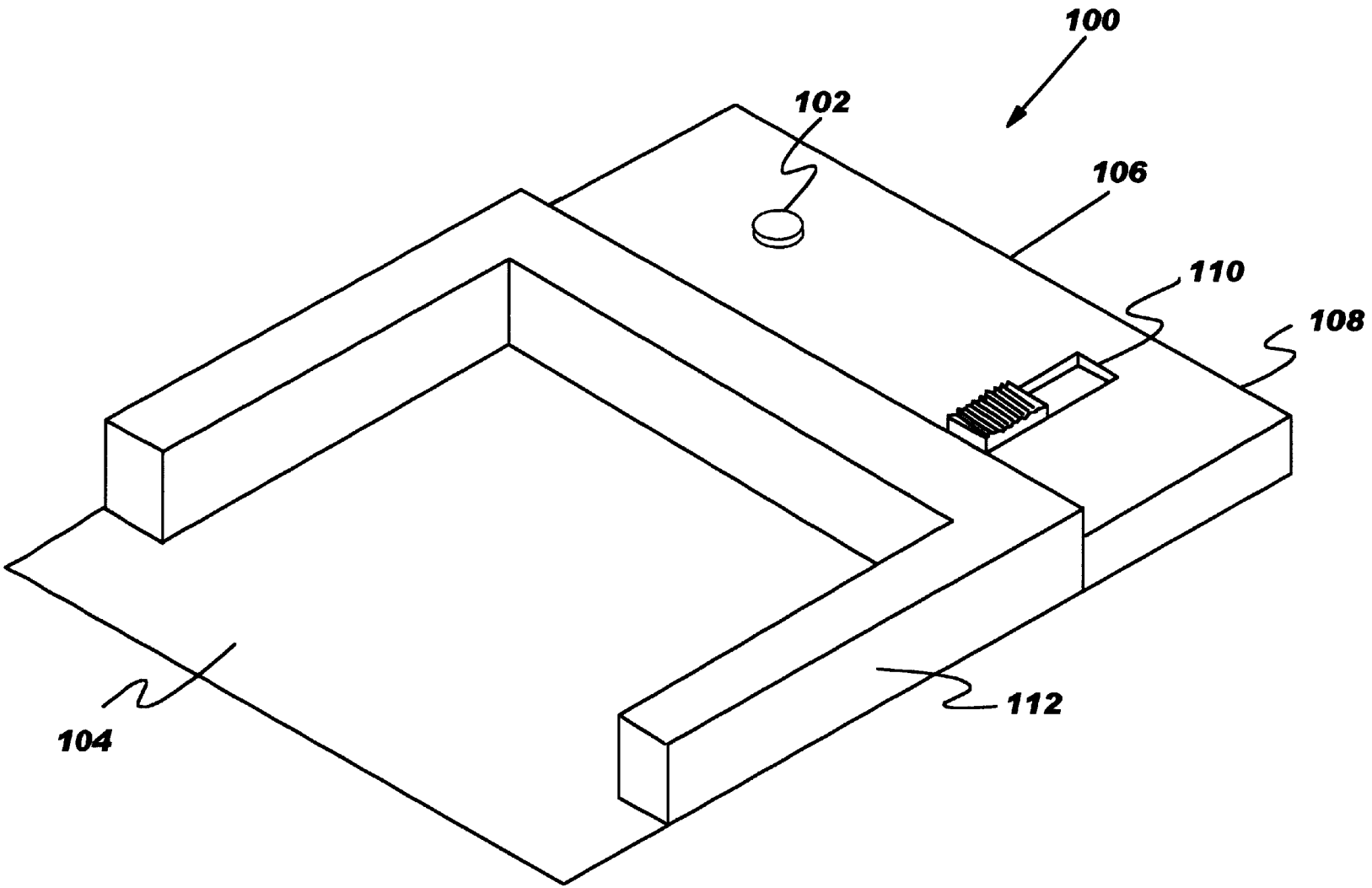
FIG. 1 is an isometric view incorporating one embodiment of the present invention.

Turning now to FIG. 1, there is illustrated an isometric view of gap gauge 100. In this embodiment, gap gauge 100 is a hand held device adaptable for measuring the print gap between a printer head (not shown) and a platen (not shown). Note, however, the present invention is not limited to measuring gaps in printers, but can be used for any other application where a gap needs to be measured. When panel unit 104 is inserted into a print gap, an electrical contact is made sending an electrical current to a suitable indicator, such as a light emitting diode, LED 102, which provides a visual indication to the user of the magnitude of the gap to be measured. Another, such indicator could be a "beeper" or sound generator chip coupled to a small speaker to provide an audible indication. Such sound generator chips and speakers are commercially available and well known by those who practice the relevant art.

The present invention is designed to measure a particular width with a small amount of tolerance. Thus, gaps of different widths will require separate gauges. However, in several industries, such as computer printers, the width of the gap must be preset to a particular distance. The width of the gap is set by a trial and error method. It is set, then measured. If it is not within a particular tolerance, another attempt is made to set the gap. The steps of setting the gap and then checking the gap by measuring its width is repeated until the gap is within a particular tolerance to a predetermined distance.

The primary components of gap gauge 100 are panel unit 104 and housing unit 106. Housing unit 106 acts as a handle for gap gauge 100. Housing unit 106 comprises of enclosure 108 which is made of plastic or another suitable material. Housing unit 106 may be set at an angle relative to panel unit 104 to clear any structure such as a printer cover. Enclosure 108 encloses most of the electronics of the present invention.

As will be discussed in reference to FIG. 3, the basic electrical components housed in enclosure 108 is a battery (FIG. 3), LED 102, on/off switch 110, and the circuitry connecting the components.

Figure 2:
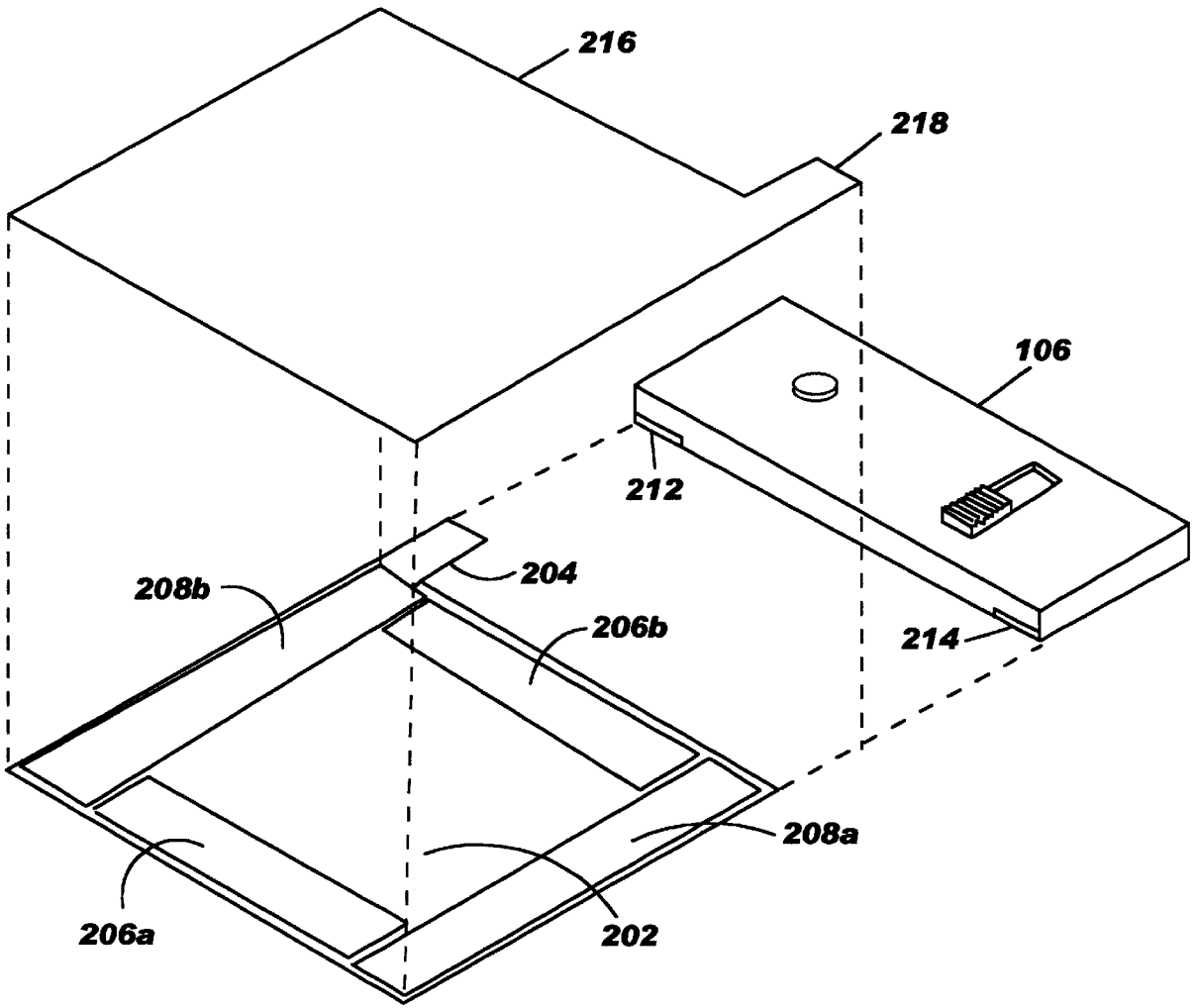
FIG. 2 is an exploded isometric view of the shim plate unit of one embodiment of the present invention.

In the embodiment illustrated in FIG. 1, panel unit 104 is made from two closely spaced, generally rectangular metal shims (FIG. 2). Panel unit 104 is designed to be inserted into the print gap to be checked. If the print gap is the correct width, the shims make contact and complete an electrical circuit (see FIG. 3) which in turn, causes LED 102 to light up. Depending on the embodiment, there may also be a guide installed to help align gap gauge 100 to the print gap to be measured. In this embodiment, which is designed to be used for printers, guide 112 is attached to panel unit 104 to assist in aligning gap gauge 100 into a print gap. Guide 112 is made from plastic or another suitable material. Its dimensions are governed by the dimensions and configuration of the printer head.

FIG. 2 is an exploded view of gap gauge 100. Shim 202 is a substantially flat metal plate with a small rectangular protrusion 204 at one corner. Shim 202 is used as a base for panel unit 104 (FIG. 1). When gap gauge 100 is assembled, protrusion 204 is inserted into slot 212 of housing unit 106 (where it makes electrical contact with the electrical circuitry (not shown) housed in housing unit 106.

Shim 216 is a flat metal plate that is substantially the mirror image of shim 202. Shim 216 can be of variable thickness to correspond to the thickness of the gap the particular gap gauge is designed to be measured. Shim 216 also has a small rectangular protrusion 218, which when assembled, is inserted into slot 214 of housing unit 106 where it makes electrical contact with the electrical circuitry (not shown).

Tape strips 208*a* and 208*b* are strips of double-sided adhesive tape which adhere shim 202 to shim 216. Tape strips 206*a* and 206*b* are strips of electrical insulating tape which act as spacers and keep shim 202 and shim 216 from making electrical contact when panel unit 104 is not in a print gap.

Figure 3:
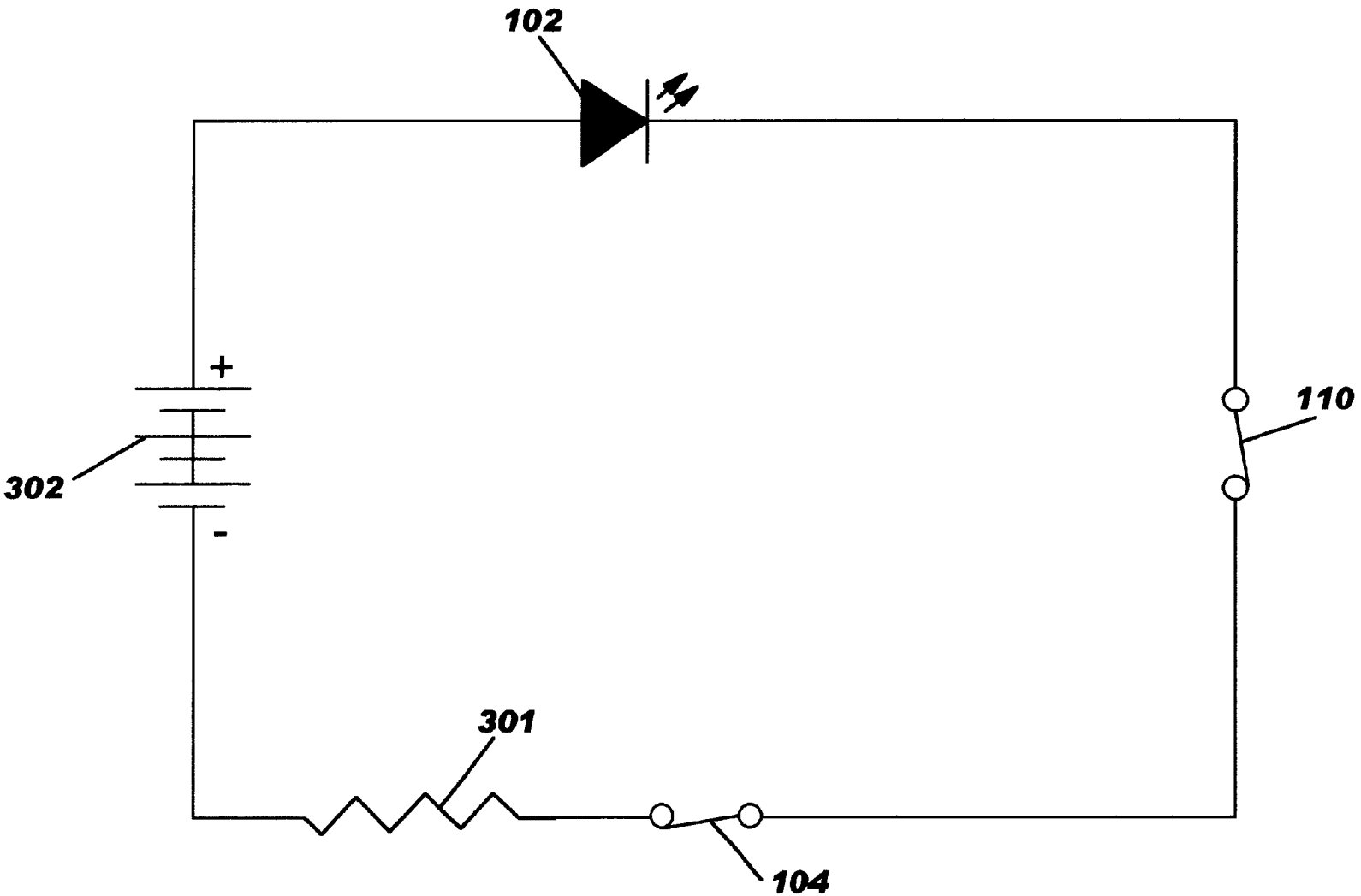
FIG. 3 is an electrical schematic diagram of the control unit of one embodiment of the present invention.

FIG. 3 schematically illustrates a typical electronic arrangement of the present invention. A suitable power supply, such as a replaceable or rechargeable battery 302 supplies power to the electronics of the invention. Battery 302 powers LED 102 when the circuit is closed. On/off switch 110 prevents battery drain by keeping the circuit open when gap gauge 100 is not in use. On/off switch 110 is a typical on/off switch designed to be mounted on a standard electric circuit board. Such on/off switches are common in the marketplace and are well known by those who practice the art. Panel unit 104 is shown in FIG. 3 as another switch because, panel unit 104 operates as a switch. Resistor 301 is provided to limit the current flow and, thus conserve power from battery 302.

When operating this embodiment, the user first turns gap gauge on by means of on/off switch 110. The user then uses housing unit 106 (FIG. 1) as a handle to insert panel unit 104 (FIG. 1) into the gap to be measured, for instance, the gap between a printhead and a platen. If the gap is the correct thickness, shim 216 (FIG. 2) will be pressed against shim 202 (FIG. 2) and the electric circuit will be complete.

Referring back to FIGS. 2 and 3, once shim 216 is pressed against shim 202, the current from battery 302 flows through LED 102 which illuminates indicating to the user that the gap is set at a predetermined distance. Current then flows through on/off switch 110 (which is switched on) and around to a common electrical connection (not shown) in housing unit 106 which is connected to protrusion 218. The current flows through shim 216 to shim 202, then to protrusion 204. Protrusion 204 connects to another common electrical connection (not shown) which is connected, to resistor 301, then to the negative terminal of battery 302, thus completing the circuit.

Panel unit 104 acts similar to a spring-loaded electrical switch. Shim 216 is relatively thin compared to shim 202 which is the base. Not only do tape strips 206*a*, 206*b*, 208*a*, and 208*b* separate shim 216 from shim 202, but these strips hold the edges of shim 216 in place. FIG. 5A represents a section view of the embodiment illustrated in FIG. 1 when panel unit 104 is not inserted into a gap. The section was cut at approximately the midpoint of shim 202 and through tape strips 208*a* and 208*b*. The thicknesses of the shims and strips of tape have been greatly exaggerated for illustration purposes. When the panel unit is not inserted, shim 216 spans between the strips of tape. It does not, therefore, make contact with shim 202 and the electrical circuit (see FIG. 3) is not complete.

Figure 5B:
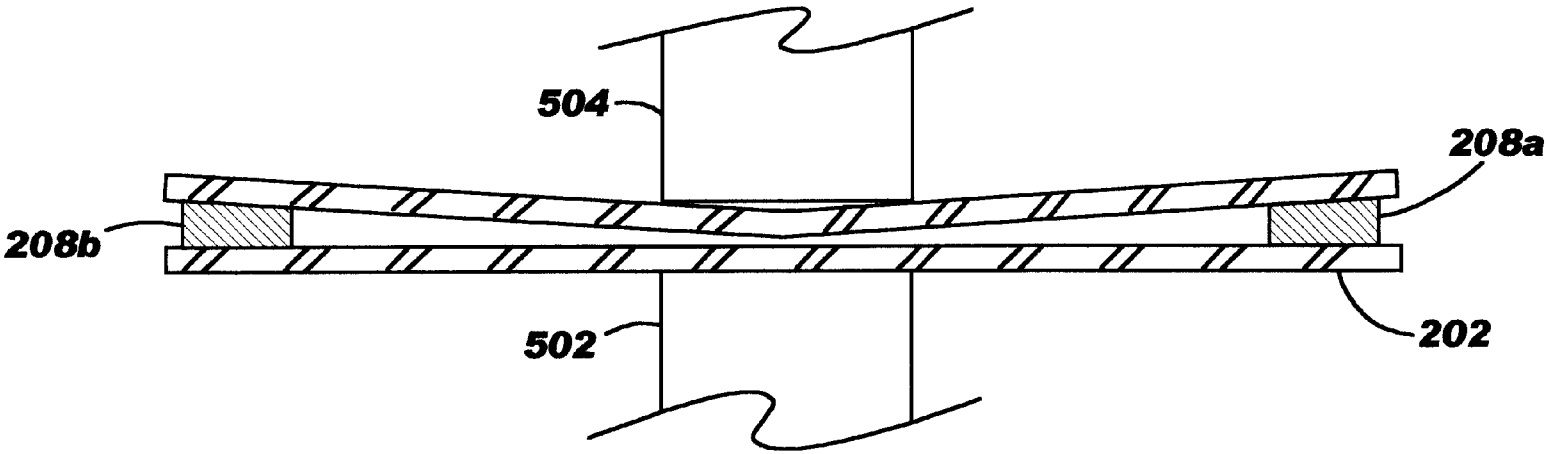
FIGS. 5A and 5B are cross-section views of the embodiment illustrated in FIG. 2.
Figure 5A:
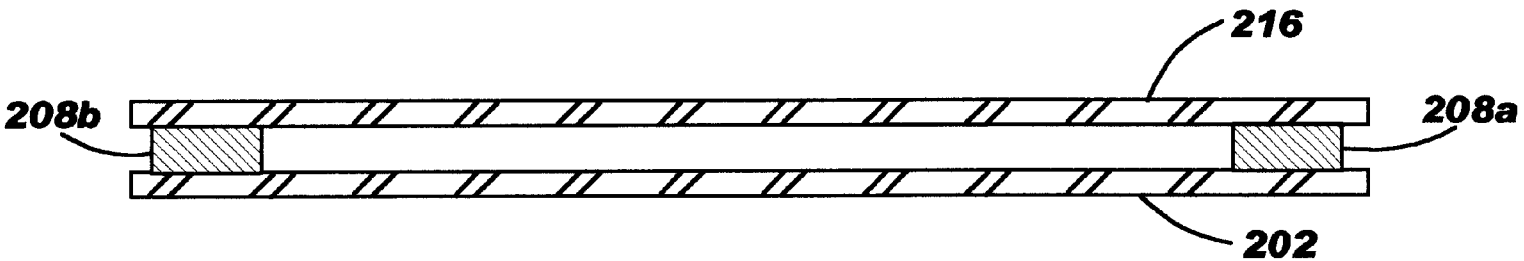

FIG. 5B, on the other hand, illustrates how shim 216 deflects when inserted into an appropriate gap between surface 502 and surface 504. If the gap is at the correct distance, shim 216 will deflect enough so that it makes contact with shim 202. This contact completes the electrical circuit, thereby causing LED 102 to illuminate. Thereafter, when LED 102 is removed from the gap, shim 216 flexes back to its original shape (illustrated in FIG. 5A) similar to the way a trampoline deflects when there is a load on it and springs back into shape when the load is removed. Once shim 216 has returned to its original shape, the electrical circuit (see FIG. 3) is broken and LED 102 is no longer illuminated.

Figure 4:
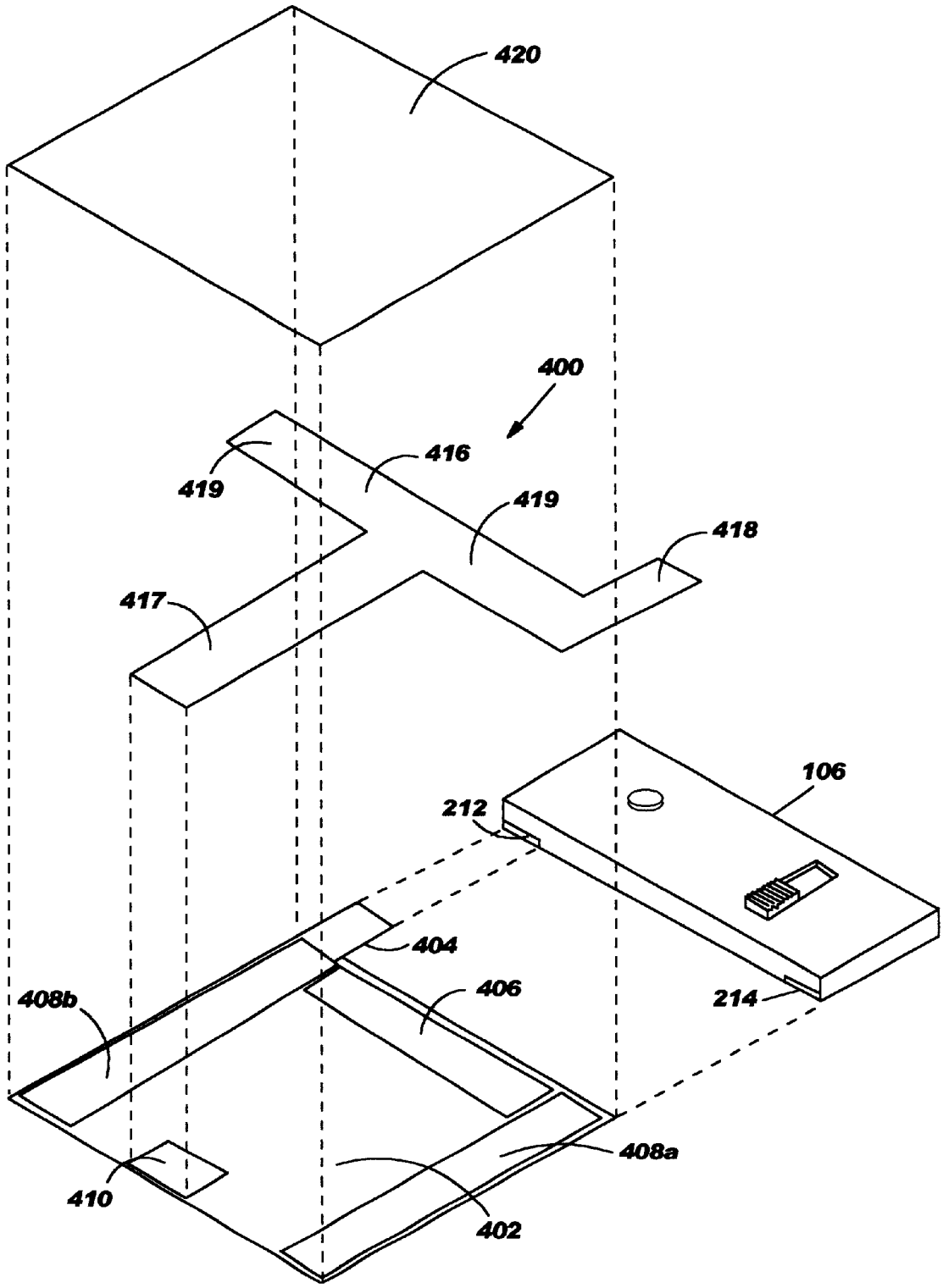
FIG. 4 is an isometric view incorporating another embodiment of the present invention.

A second embodiment is illustrated in FIG. 4 which is an exploded isometric view of gap gauge 400. The second embodiment is similar to the first embodiment except that it uses a t-shaped upper shim, rather than a rectangular shaped plate.

For brevity and clarity, a description of those parts which are identical or similar to those described in connection with the first embodiment illustrated in FIGS. 1–3 will not be repeated here. Reference should be made to the foregoing paragraphs with the following description to arrive at a complete understanding of this second embodiment.

The embodiment shown in FIG. 4 uses an identical housing unit to the first embodiment. The panel unit is different and a mylar film is also used as a cover. In the second embodiment, shim 402 is a substantially flat metal plate with a small rectangular protrusion 404 at one corner. Shim 402 is used as a base for this embodiment. Upper shim 416 is a flat metal plate that is shaped similar to a "t." Upper arm 419 of shim 416 extends to a length that is substantially the same as the width of base shim 402. Bottom leg 417 of shim 416 extends from the midpoint of arm 419 to a distance that is substantially the width of base shim 402. The ends of upper arm 419 and leg 417 thus, are substantially flush with the edges of shim 402 when shim 416 is placed over shim 402. Additionally, one end of arm 419 has protrusion 418 which when the invention is assembled, is inserted into slot 214 of housing unit 106 where it makes electrical contact with the electrical circuitry (not shown). Shim 416 can be of variable thickness to correspond to the thickness of the gap the particular gap gauge is designed to be measured.

Tape strips 408*a* and 408*b* are strips of double-sided adhesive tape which adhere shim 402 to shim 416. Depending whether guide 112 (FIG. 1) is used, tape strip 406 is a strip of electrical insulating tape or a strip of adhesive tape. In any case tape strip 406 acts as a spacer and keeps shim 402 and top arm 419 from making electrical contact when the panel unit is not in a print gap. Tape strip 410 is also a double-sided adhesive tape designed to adhere the lower end of leg 417 to shim 402. Mylar film 420 is provided to keep dust out of the space between shim 416 and shim 402. Such mylar film is commercially available in extremely thin thicknesses.

In operation, the panel unit of the second embodiment acts in a similar manner to the panel unit of the first embodiment. Shim 416 is relatively thin compared to shim 402 which is the base. Tape strips 406, 408*a*, 408*b*, and 410 separate upper shim 416 from base shim 402. They secure the edges of shim 416 in place. FIG. 6A represents a section view of the second embodiment illustrated in FIG. 4 when the panel unit is not inserted into a gap. The section view was cut approximately at the midpoint of shim 402 and through tape strips 410 and 406. The thicknesses of the shims and strips of tape have been exaggerated for illustration purposes. When the panel unit is not inserted into a gap, shim 416 spans between the strips of tape. It does not, therefore, make contact with shim 402 and the electrical circuit is not complete.

Figure 6B:
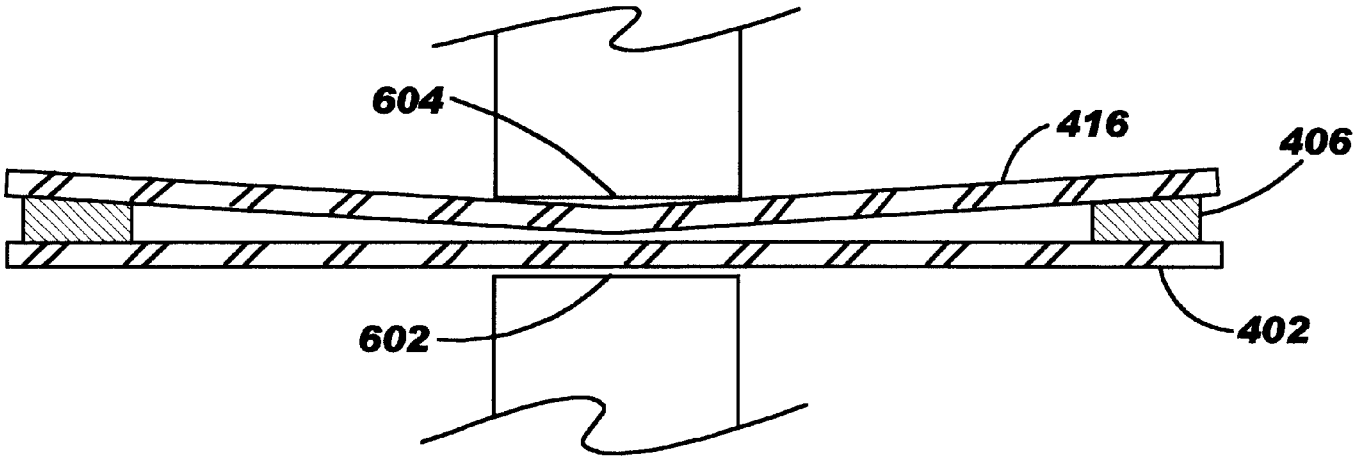
FIGS. 6A and 6B are cross-section views of the embodiment illustrated in FIG. 4.
Figure 6A:
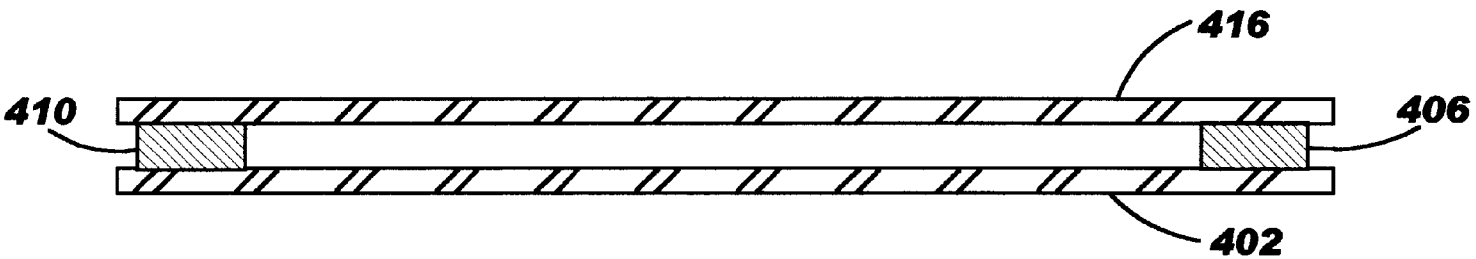

FIG. 6B illustrates how shim 416 deflects when inserted into an appropriate gap between surface 602 and surface 604. If the gap is at the correct distance, shim 416 will deflect enough to make contact with shim 402. This contact completes the electrical circuit (FIG. 3), thereby causing LED 102 (FIG. 1) to illuminate. Thereafter, when the panel unit is removed from the gap, shim 416 flexes back to its original shape (illustrated in FIG. 6A) breaking the electrical circuit.

In sum, the electronic feeler gauge has several substantial advantages over the prior art. Judging the correct amount of frictional resistance is often subjective and is dependent on the experience of the operator. The present invention provides an objective indication when the gap has been adjusted correctly. Thus, the learning curve is greatly reduced and the present invention may be used by more inexperienced technicians. Additionally, more consistent results will be obtained by different operators because of the objectivity introduced by the present invention.

Although the invention has been described with reference to specific embodiments, these descriptions are not meant to be construed in a limiting sense. Various modifications of the disclosed embodiments, as well as alternative embodiments of the invention will become apparent to persons skilled in the art upon reference to the description of the invention. It is therefore, contemplated that the claims will cover any such modifications or embodiments that fall within the true scope of the invention.

What is claimed is:

1. A device for confirming that a gap between a first surface and a spaced apart, opposed second surface is set to a predetermined width, comprising:

a gap measuring element insertable into said gap for engagement with said first surface and said second surface;

an indicator coupled to said gap measuring element for automatically indicating when said gap measuring element is in engagement with both said first surface and said second surface; and at least one electrical switch in said gap measuring element which changes state when said gap measuring element engages said first surface and said second surface.

2. The device of claim 1, wherein said electrical switch comprises a first plate element and a second plate element coupled such that when said first plate element engages said first surface and said second plate element engages said second surface said first plate element also engages said second plate element such that current can be transmitted through said first and second plate elements.

3. The device of claim 2, wherein when said gap measuring element is not engaged with said first surface and said second surface, said first plate element and second plate element are separated by a distance such that said first plate element does not engage with said second plate element.

4. The device of claim 2, further comprising a dust covering means for preventing dust from lodging between said first plate element and said second plate element.

5. The device of claim 1, wherein said indicator further comprises an electrical circuit which comprises said electrical switch coupled to a power source, and a sensory conformation unit coupled to said power source such that when said electrical switch is closed said power source powers said sensory confirmation unit and when said electrical switch is open, said power source does not power said sensory confirmation unit.

6. The device of claim 5, wherein said electrical circuit further comprises a conventional electrical on/off switch which is coupled to said power source.

7. The device of claim 5, wherein said sensory confirmation unit is a light emitting diode.

8. The device of claim 5, wherein said sensory confirmation unit is a beeper.

9. A gauge for confirming that a gap between a first surface and a spaced apart, opposed second surface is set a predetermined distance, comprising:

a power source;

an indicator coupled to said power source; and a switch having a first plate member and a second plate member such that said power source is connected to said indicator when said first plate member is in contact with said first surface and said second plate member is in contact with said second surface, said switch coupled to said power source and said indicator, wherein said switch operates to power said indicator with said power source when said gap is set to said predetermined distance, and wherein said switch operates to not power said indicator with said power source when said gap is not set to said predetermined distance.

10. The gauge of claim 9, further comprising a dust covering means for preventing dust from lodging between said first plate element and said second plate element.

11. A gauge for verifying if a gap between two opposing surfaces is set at a predetermined distance, said gauge comprising:

a detecting means for insertion into said gap, said detecting means having two plate elements which make electrical contact when inserting into said gap set at said predetermined distance; and an indicator means coupled to said detecting means for automatically determining if said gap is set to said predetermined distance.

12. The gauge of claim 11, wherein said indicator means further comprises an electrical circuit comprising a power source connected to a light emitting diode, and wherein said detecting means is an electrical switch in said electrical circuit capable of changing states when said two plate elements make electrical contact.

13. The gauge of claim 12, wherein said electrical circuit further comprises a means for disconnecting said power source from said circuit when said gauge is not in use.

14. The gauge of claim 13 further comprising an enclosure means for encasing said power source, said indicator and said means for disconnecting said power source, said enclosure means adapted to be gripped by a user for moving said gauge into and out of said gap.

15. The gauge of claim 11, wherein said detecting means further comprises a means for separating said plate elements when said plate elements are not contacting said opposing surfaces.

16. A method for adjusting a gap between a first surface and an opposing second surface comprising:

a. inserting a switch into the gap in a first direction, wherein the switch comprises a first plate coupled to a second plate, b. moving said switch in a second direction, c. determining whether the gap is set to a predetermined distance by repeating steps (a) through (b) and checking an indicator, d. adjusting the gap, e. repeating steps (a) through (d) until the gap is adjusted to the predetermined distance, wherein the indicator comprises an electrical circuit comprising a power source coupled to the switch such that when the switch is closed, the power source powers a light emitting diode, and when the switch is opened, the power source does not power said light emitting diode, f. placing the first surface of the gap in contact with the first plate, g. placing the second surface of the gap in contact with the second plate such that the first plate contacts the second plate, and h. passing a current through the first and second plates such that the electrical circuit can power the light emitting diode.

* * * * *